US011957236B2

(12) United States Patent
Yeates et al.

(10) Patent No.: US 11,957,236 B2
(45) Date of Patent: Apr. 16, 2024

(54) INTEGRAL ACCESSORY ATTACHMENT SYSTEM

(71) Applicant: Sentry Solutions Products Group LLC, Virginia Beach, VA (US)

(72) Inventors: Eric M. Yeates, Virginia Beach, VA (US); Frederick W. Storms, Jr., Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 296 days.

(21) Appl. No.: 17/439,934

(22) PCT Filed: May 29, 2020

(86) PCT No.: PCT/US2020/035158

§ 371 (c)(1),
(2) Date: Sep. 16, 2021

(87) PCT Pub. No.: WO2020/243456

PCT Pub. Date: Dec. 3, 2020

(65) Prior Publication Data

US 2022/0248835 A1 Aug. 11, 2022

Related U.S. Application Data

(60) Provisional application No. 62/853,947, filed on May 29, 2019.

(51) Int. Cl.
*A45F 5/02* (2006.01)

(52) U.S. Cl.
CPC ..... *A45F 5/021* (2013.01)

(58) Field of Classification Search
CPC ..... A45F 5/021; A45F 5/02; Y10T 24/1397; Y10T 24/1498
See application file for complete search history.

(56) References Cited

U.S. PATENT DOCUMENTS

| | | | | |
|---|---|---|---|---|
| 4,752,054 | A * | 6/1988 | Jonsson | H02G 11/003 248/51 |
| 6,901,636 | B2 * | 6/2005 | Kim | B65D 63/1018 24/17 R |
| 11,432,642 | B2 * | 9/2022 | Ross | F16B 45/015 |
| 11,661,254 | B1 * | 5/2023 | Storms, Jr. | B65D 63/1027 24/712 |
| 11,684,141 | B1 * | 6/2023 | Storms, Jr. | A45F 5/00 24/712 |

* cited by examiner

*Primary Examiner* — Robert Sandy
(74) *Attorney, Agent, or Firm* — Shaddock Law Group, PC

(57) ABSTRACT

An integral accessory attachment system having an accessory body having an accessory panel, a connection portion, and an attachment panel, wherein one or more attachment elements extend as an integral extension of a portion of the attachment panel; and an attachment interface layer, wherein the attachment interface layer is attached or coupled to at least a portion of the attachment panel, wherein a plurality of attachment slots are provided through at least a portion of the attachment interface layer, and wherein at least one locking slot is formed through the attachment interface layer such that at least a portion of the attachment element is positionable through at least one attachment slot and wherein a narrowed portion of the attachment element is positionable within the locking slot.

20 Claims, 14 Drawing Sheets

INTEGRAL ACCESSORY ATTACHMENT SYSTEM

CROSS-REFERENCE TO RELATED APPLICATIONS

This patent application claims the benefit of U.S. Patent Application Ser. No. 62/853,947, filed May 29, 2019, the disclosure of which is incorporated herein by reference in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of modular attachment systems. More specifically, the present disclosure relates to an integral accessory attachment system.

2. Description of Related Art

It is advantageous be able to configure and/or reconfigure various pouches, pockets, holsters, holders, and other accessories on items such as, for example, articles of clothing, vests, plate carriers, backpacks, packs, platforms, and other carriers.

It is generally known to removably attach such items using a MOLLE or other similar attachment system. The term MOLLE (Modular Lightweight Load-carrying Equipment) is used to generically describe load bearing systems and subsystems that utilize corresponding rows of interwoven webbing for modular pouch, pocket, and accessory attachment.

The MOLLE system is a modular system that incorporates the use of corresponding rows of webbing stitched onto a piece of equipment, such as a vest, and the various MOLLE compatible pouches, pockets, and accessories, each accessory having mating rows of stitched webbing. MOLLE compatible pouches, pockets, and accessories of various utility can then be attached or coupled wherever MOLLE webbing exists on the equipment.

The terms "MOLLE-compatible" or "MOLLE" system are not used to describe a specific system, but to generically describe accessory attachment systems that utilize interwoven PALS (Pouch Attachment Ladder System) webbing for modular accessory attachment portions.

An exemplary MOLLE compatible carrier portion includes a plurality of substantially parallel rows of spaced apart, horizontal carrier webbing elements. Each of the carrier webbing elements is secured to a backing or carrier material, by vertical stitching, at spaced apart locations, such that a tunnel segment is formed between the carrier material and the carrier webbing elements between each secured location of the carrier webbing elements. Each of the tunnel segments is formed substantially perpendicular to a longitudinal axis or direction of the carrier webbing elements.

The MOLLE compatible carrier portion, or MOLLE system grid, typically consists of horizontal rows of 1 inch (2.5 cm) webbing, spaced 1 inch apart, and attached or coupled to the carrier material at 1.5 inch (3.8 cm) intervals.

An exemplary accessory includes a plurality of substantially parallel, spaced apart accessory webbing elements. The accessory webbing elements are spaced apart so as to correspond to the spaces between the spaced apart carrier webbing elements. The accessory webbing elements are secured to the accessory at spaced apart locations, such that an accessory tunnel segment is formed between the accessory and the accessory webbing element between each secured location of the accessory webbing element. Each of the accessory tunnel segments is formed substantially perpendicular to a longitudinal direction of the accessory webbing elements.

When the accessory is placed adjacent the carrier material such that the accessory webbing elements are within the spaces between the spaced apart carrier webbing elements (and the carrier webbing elements are within the spaces between the spaced apart accessory webbing elements) and corresponding tunnel segments and accessory tunnel segments are aligned, a strap or coupling element may be interwoven between the aligned tunnel segments and accessory tunnel segments (alternating between horizontal carrier webbing element portions on the host or carrier material and horizontal webbing portions on the accessory) to removably attach the accessory to the carrier material.

Thus, through the use of a MOLLE or MOLLE-type system, an accessory may be mounted to a variety of carrier materials. Likewise, if a particular carrier material includes a MOLLE compatible system, a variety of accessories may be interchangeably mounted to the platform to accommodate a variety of desired configurations.

MOLLE compatible systems allow, for example, various pouch arrangements to be specifically tailored to a desired configuration and then reconfigured, if desired. Various desired pouches, pockets, and accessories can be added and undesired or unnecessary pouches, pockets, or accessories can be removed.

It is generally known to include belt loops made of loops of material or parallel apertures through which a belt can be threaded to attach and accessory to a belt.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical "MOLLE-compatible" or "MOLLE" system arrangement has various shortcomings.

For example, known "MOLLE-compatible" or "MOLLE" systems typically utilize strap or coupling elements that are either separate portions of material sewn to the accessory or separate portions of plastic or other material. If sewn, the strap or coupling elements can be separated from the accessory. If the strap or coupling elements comprise separate portions of plastic other material, the strap or coupling elements can be lost or misplaced. In either case, the bulk of known strap or coupling elements typically creates a significant gap between the accessory and the carrier material, when interwoven between the accessory in the carrier material.

Additionally, known belt loops or similar accessory attachments are affixed to the accessory to maintain the accessory in a single orientation relative to the belt. For example, belt loops may be attached or coupled to an accessory such that the belt can be positioned or interwoven through the belt loops to maintain the accessory in a substantially horizontal manner, relative to the belt. Alternatively, belt loops may be attached or coupled to an accessory such that the belt can be positioned or interwoven through the belt loops to maintain the accessory in a substantially vertical manner, relative to the belt. This results a single option for attaching or coupling an accessory to a belt, either in a substantially horizontal manner or a substantially vertical manner, depending upon the position of the belt loops. This only provides for attachment or coupling a single directional orientation and does not allow use of the option of attaching or coupling the accessory to the belt in either a substantially horizontal or substantially vertical manner.

In order to solve these and other shortcomings of known "MOLLE-compatible" or "MOLLE" system strap or coupling elements and/or known belt loops or other accessory attachments, the integral accessory attachment system of the present disclosure provides an attachment interface layer including at least some of an accessory body having an accessory panel, a connection portion, and an attachment panel, wherein one or more attachment elements extend as an integral extension of a portion of the attachment panel; and an attachment interface layer, wherein the attachment interface layer is at least partially attached or coupled to at least a portion of the attachment panel, wherein a plurality of attachment slots are provided through at least a portion of the attachment interface layer, and wherein at least one locking slot is formed through the attachment interface layer such that at least a portion of the attachment element is positionable through at least one attachment slot and wherein attachment element notches of the attachment element are positionable within the locking slot.

In various exemplary, non-limiting embodiments, the attachment element notches comprise opposing attachment element notches formed in a portion of the attachment element and define a narrowed portion of the attachment element.

In various exemplary, non-limiting embodiments, an accessory interface layer is attached or coupled to at least a portion of the accessory panel.

In various exemplary, non-limiting embodiments, a plurality of accessory apertures are formed through the accessory interface layer.

In various exemplary, non-limiting embodiments, the accessory apertures are formed in a repeating or semi-repeating pattern.

In various exemplary, non-limiting embodiments, the accessory apertures are formed in a repeating or semi-repeating pattern of spaced apart rows and/or columns.

In various exemplary, non-limiting embodiments, tunnel segments are created between accessory apertures, between at least a portion of the accessory interface layer and the accessory panel.

In various exemplary, non-limiting embodiments, each of the accessory apertures comprises 2, spaced apart, substantially linear aperture sides, wherein each aperture side extends from an upper terminal end to a lower terminal end, wherein an arcuate side joins the upper terminal ends of the aperture sides, and wherein an arcuate side joins the lower terminal ends of the aperture sides.

In various exemplary, non-limiting embodiments, 2 or more attachment slots are formed at spaced apart locations through the attachment interface layer, and wherein tunnel segments are created between attachment slots, between at least a portion of the attachment interface layer and the attachment panel.

In various exemplary, non-limiting embodiments, the integral accessory attachment system of the present disclosure provides an accessory body having an accessory panel, a connection portion, and an attachment panel, wherein one or more attachment elements extend as an integral extension of a portion of the attachment panel; an attachment interface layer at least partially attached or coupled to at least a portion of the attachment panel, wherein a plurality of attachment slots are provided through at least a portion of the attachment interface layer, and wherein at least a portion of each of the one or more attachment elements is positionable through at least one of the attachment slots; and an accessory interface layer at least partially attached or coupled to at least a portion of the accessory panel, wherein a plurality of accessory apertures are formed through the accessory interface layer.

In various exemplary, non-limiting embodiments, at least one locking slot is formed through the attachment interface layer and wherein attachment element notches of each of the one or more attachment elements are positionable within the locking slot.

In various exemplary, non-limiting embodiments, the integral accessory attachment system of the present disclosure provides an accessory body having an accessory panel, a connection portion, and an attachment panel; and one or more attachment elements extending as an integral extension of a portion of the attachment panel, wherein a plurality of attachment slots are provided through at least a portion of the attachment panel, and wherein at least a portion of each of the one or more attachment elements is positionable through at least one of the attachment slots.

In various exemplary, non-limiting embodiments, at least one locking slot is formed through the attachment panel such that at least a portion of attachment element notches of each of the one or more attachment elements are positionable within the locking slot.

In various exemplary, non-limiting embodiments, the attachment element notches comprise opposing attachment element notches formed in a portion of the attachment element and define a narrowed portion of the attachment element.

In various exemplary, non-limiting embodiments, a plurality of accessory apertures are formed through the accessory panel.

In various exemplary, non-limiting embodiments, the accessory apertures are formed in a repeating or semi-repeating pattern.

In various exemplary, non-limiting embodiments, the accessory apertures are formed in a repeating or semi-repeating pattern of spaced apart rows and/or columns.

In various exemplary, non-limiting embodiments, tunnel segments are created between accessory apertures, between at least a portion of the accessory panel and a cavity of the accessory body.

In various exemplary, non-limiting embodiments, each of the accessory apertures comprises 2, spaced apart, substantially linear aperture sides, wherein each aperture side extends from an upper terminal end to a lower terminal end, wherein an arcuate side joins the upper terminal ends of the aperture sides, and wherein an arcuate side joins the lower terminal ends of the aperture sides.

In various exemplary, non-limiting embodiments, 2 or more attachment slots are formed at spaced apart locations through the attachment panel, and wherein tunnel segments are created between attachment slots, between at least a portion of the attachment panel and a cavity of the accessory body.

Accordingly, the present disclosure separately and optionally provide an integral accessory attachment system that allows a user to readily attach an accessory to an attachment interface layer.

The present disclosure separately and optionally provide an integral accessory attachment system that includes attachment elements formed integral to a portion of an accessory body.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
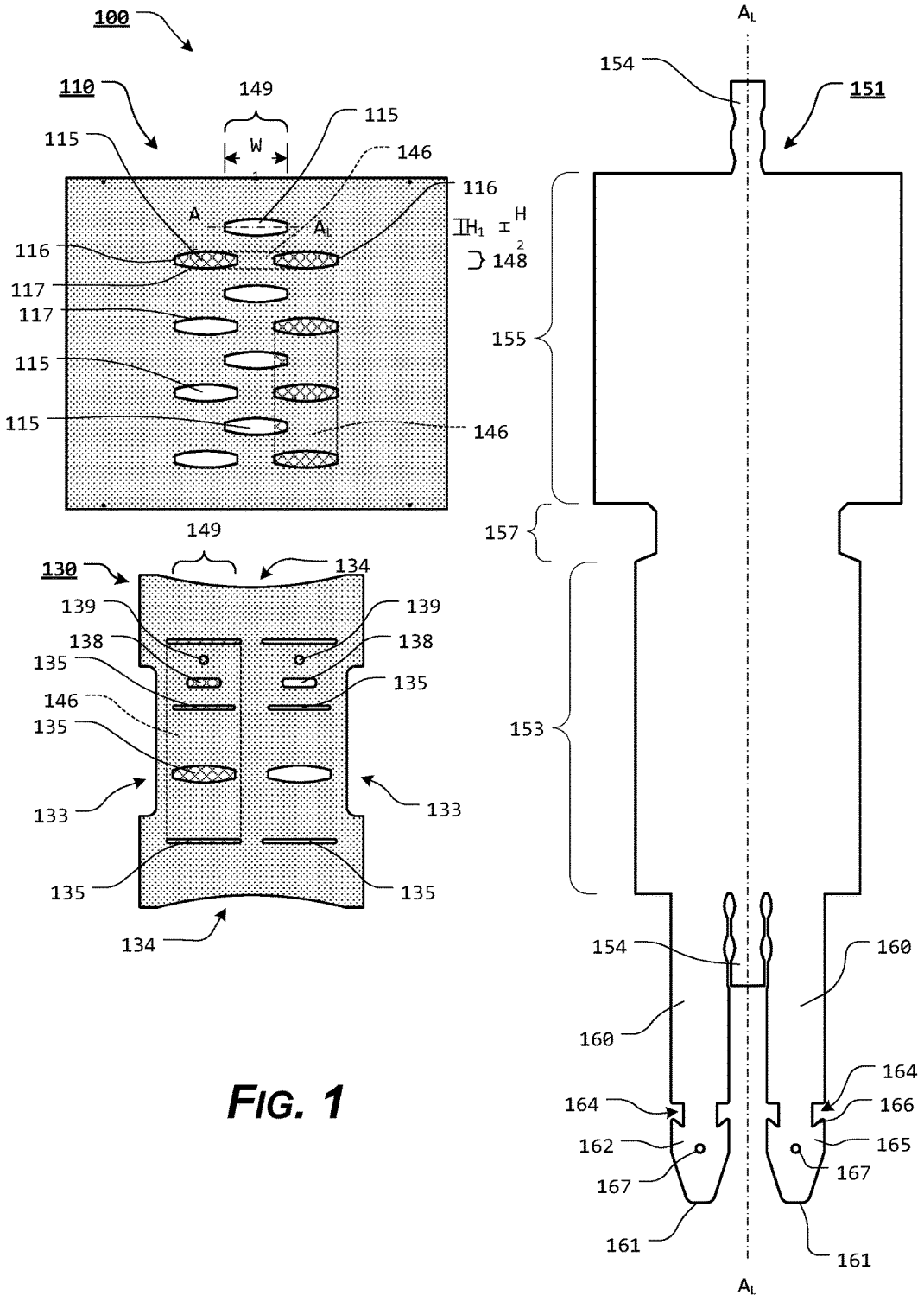
FIG. 1 illustrates a front view of certain exemplary components of an exemplary embodiment of an integral accessory attachment system, according to the present disclosure.
Figure 2:
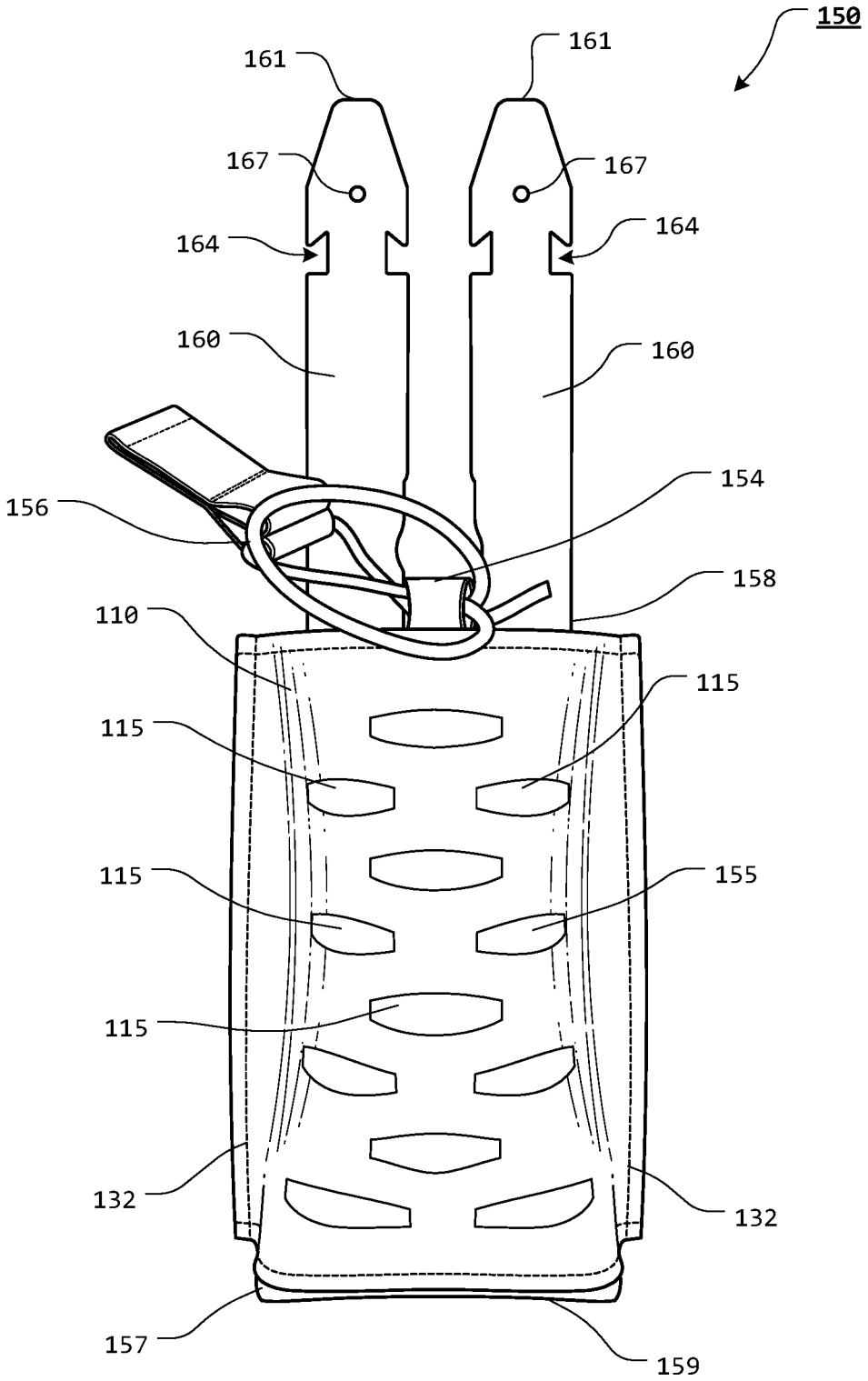
FIG. 2 illustrates a front view of an accessory having an integral accessory attachment system according to an exemplary embodiment of the present disclosure.
Figure 3:
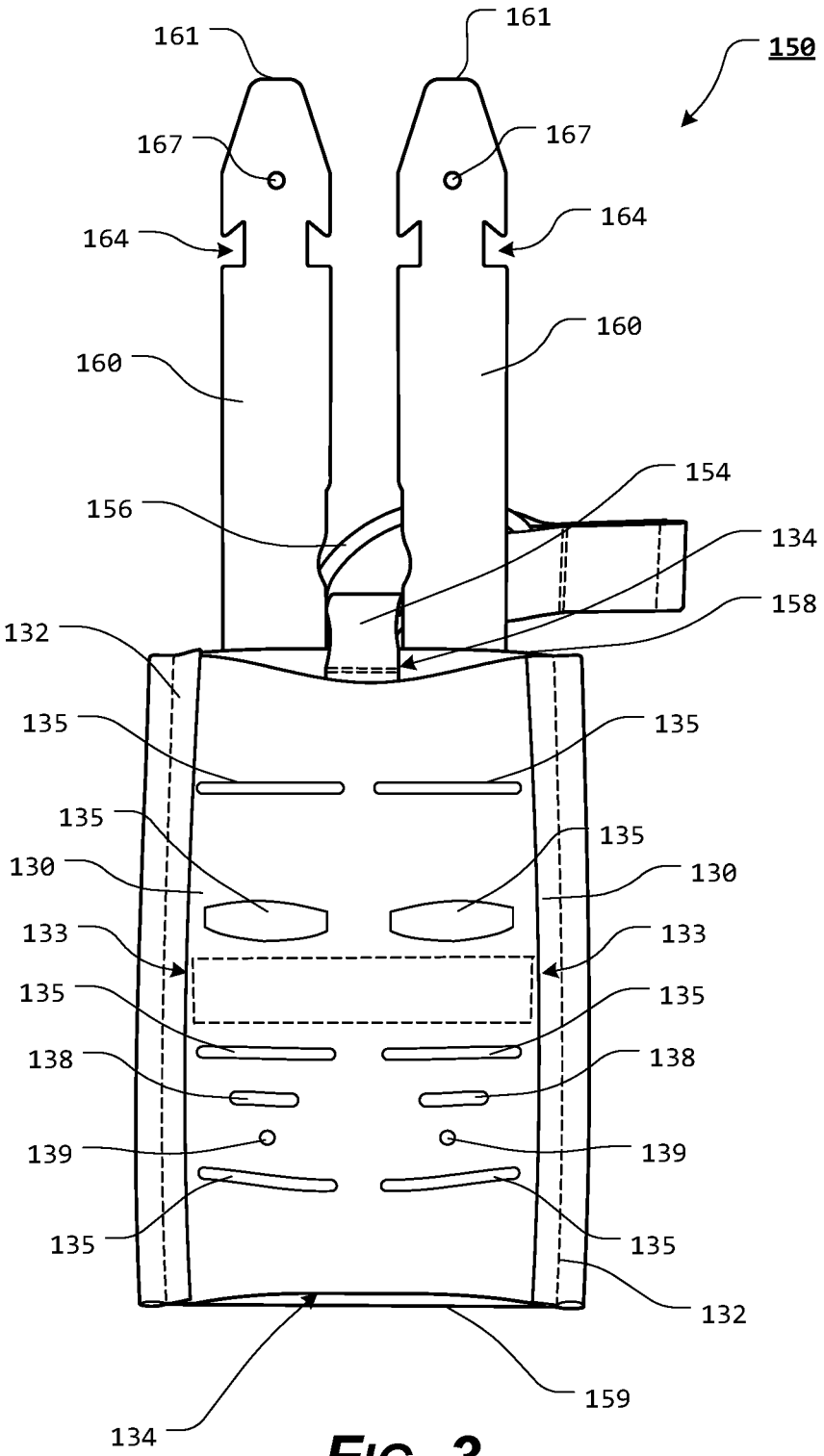
FIG. 3 illustrates a rear view of an accessory having an integral accessory attachment system according to an exemplary embodiment of the present disclosure.
Figure 4:
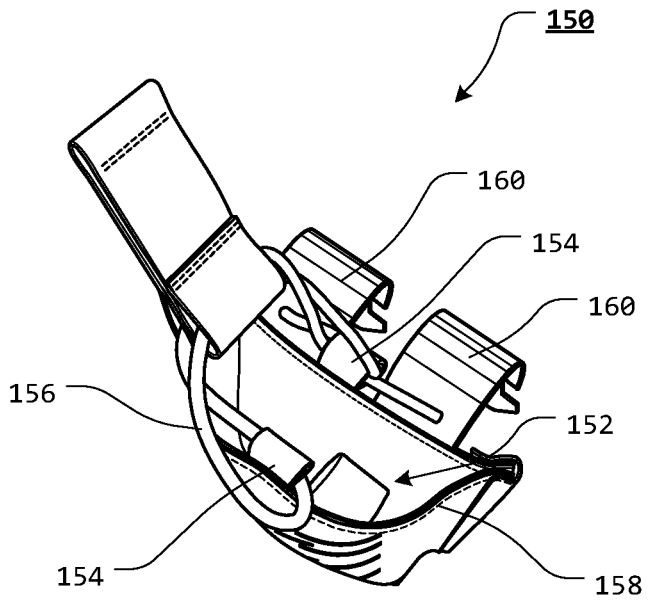
FIG. 4 illustrates a top, perspective view of an accessory having an integral accessory attachment system according to an exemplary embodiment of the present disclosure.
Figure 5:
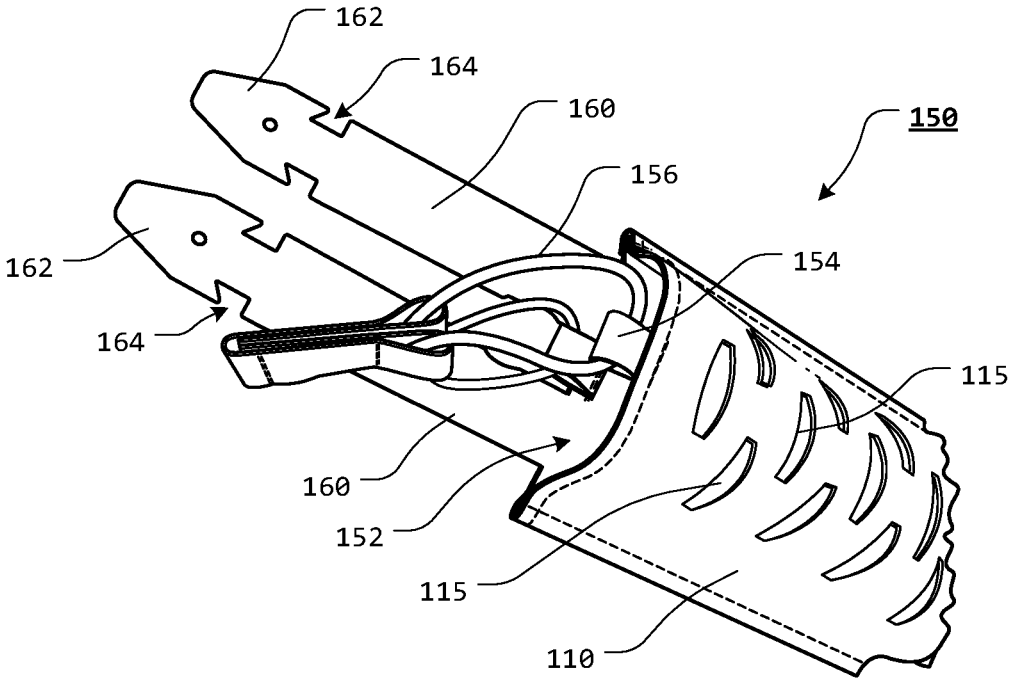
FIG. 5 illustrates an upper, perspective view of an accessory having an integral accessory attachment system, according to an exemplary embodiment of the present disclosure.
Figure 6:
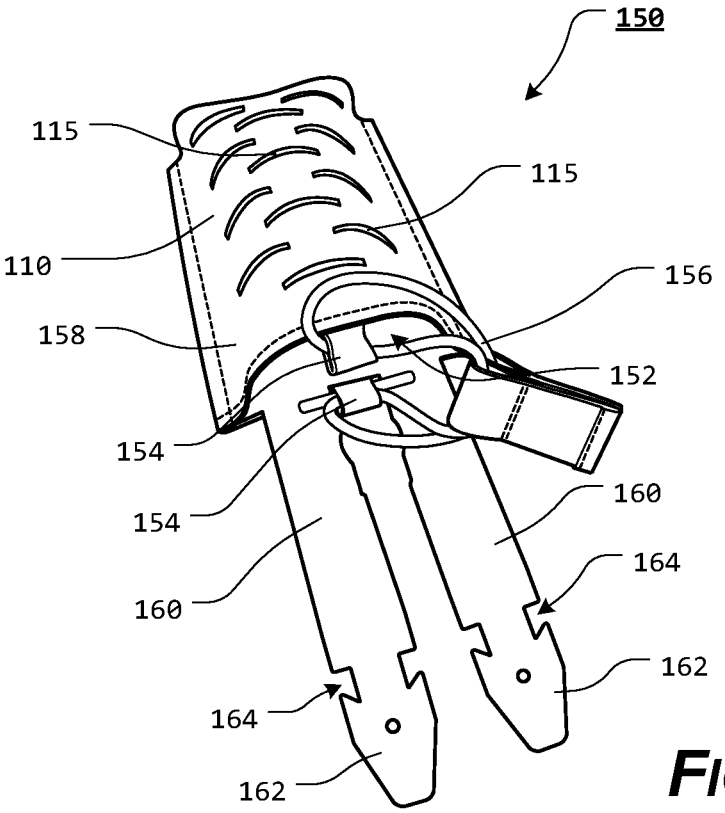
FIG. 6 illustrates an upper, perspective view of an accessory having an integral accessory attachment system, according to an exemplary embodiment of the present disclosure.
Figure 7:
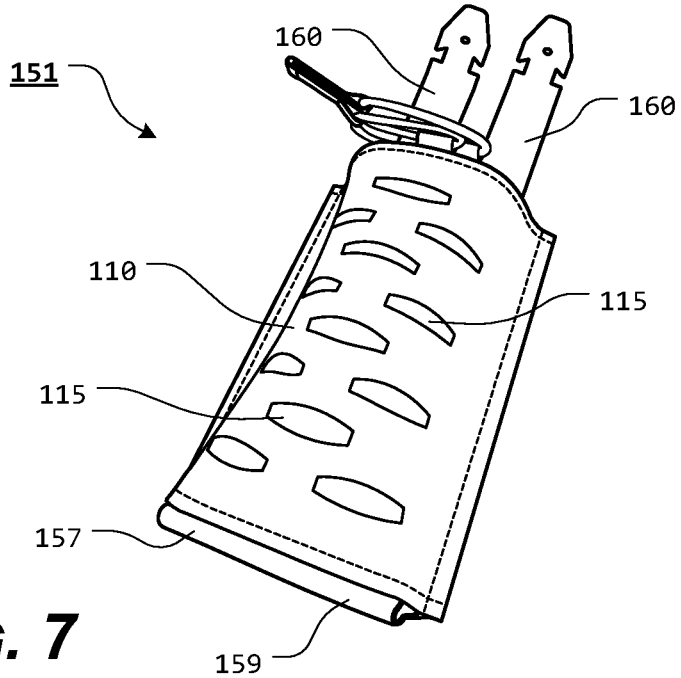
FIG. 7 illustrates a lower, perspective view of an accessory having an integral accessory attachment system, according to an exemplary embodiment of the present disclosure.
Figure 8:
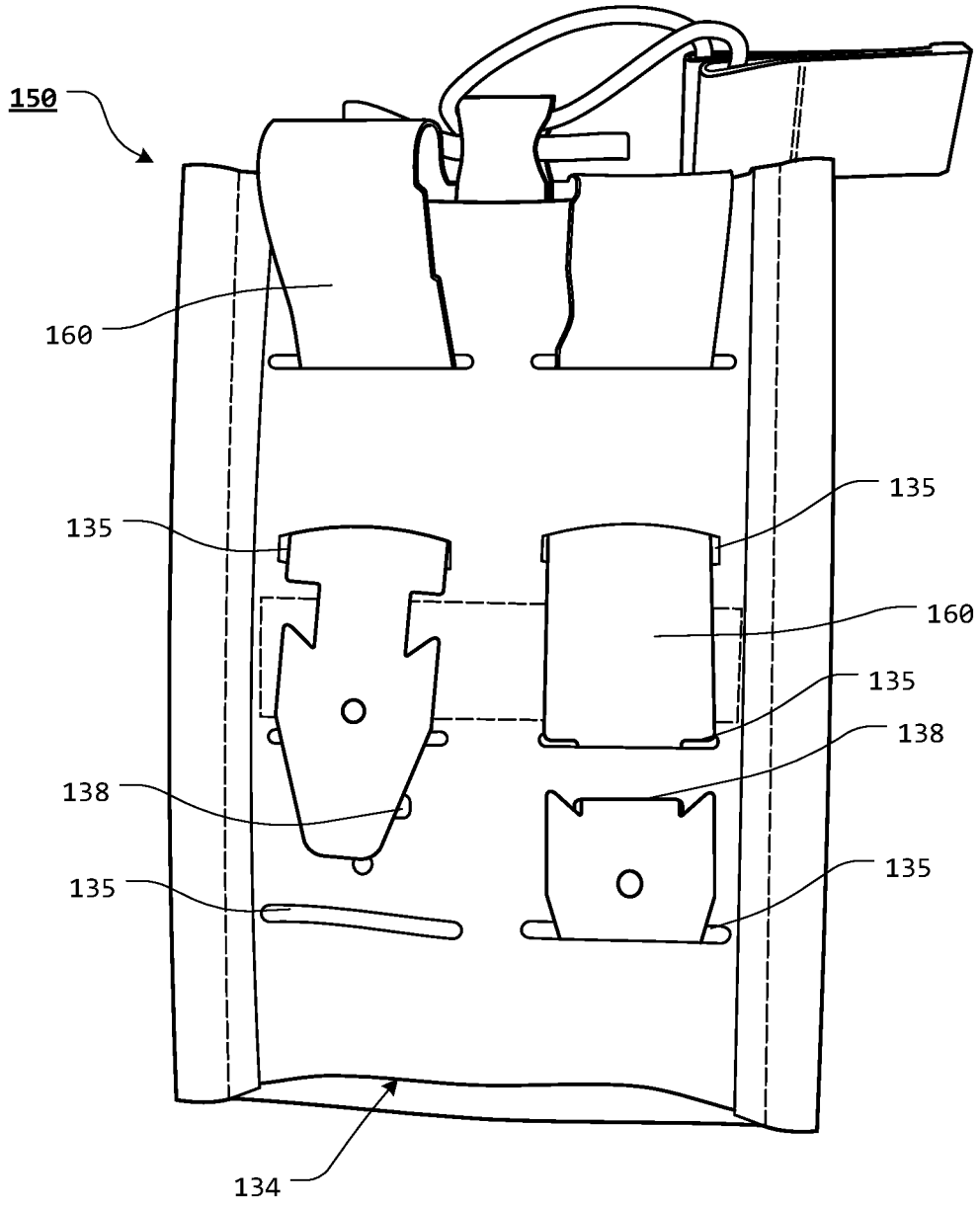
FIG. 8 illustrates a rear view of an accessory having an integral accessory attachment system, according to an exemplary embodiment of the present disclosure.
Figure 9:
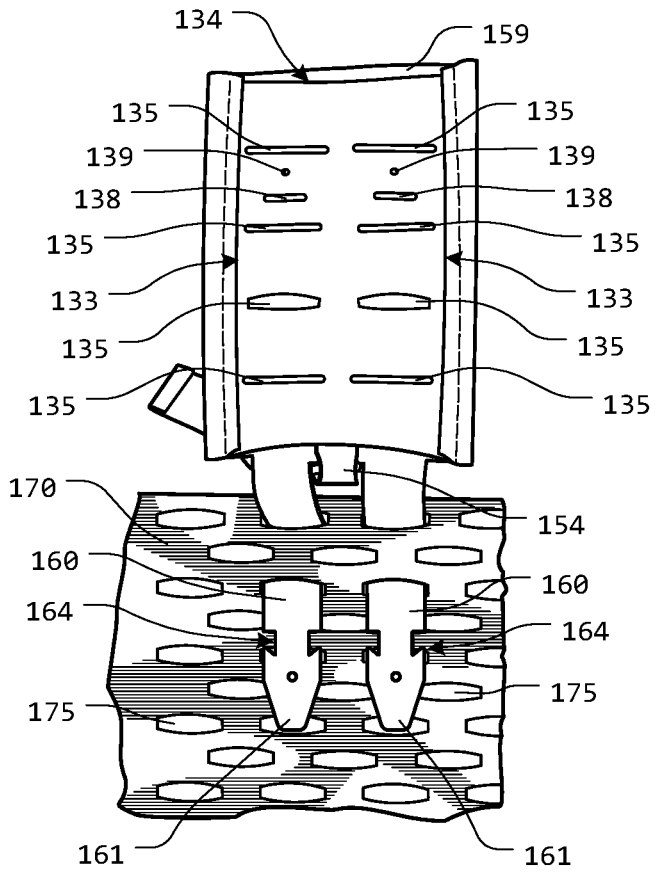
FIG. 9 illustrates a rear view of an accessory having an integral accessory attachment system, wherein the accessory is aligned with an accessory attachment portion for attachment according to an exemplary embodiment of the present disclosure.
Figure 10:
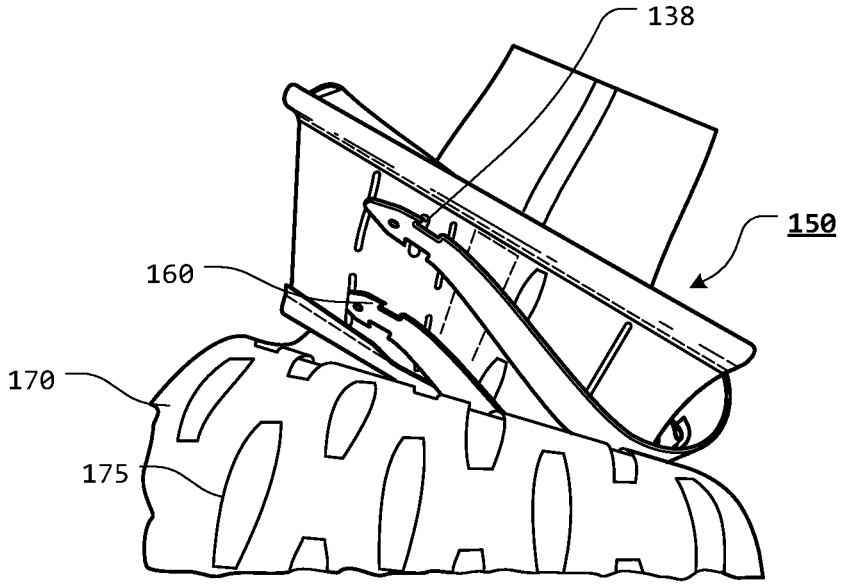
FIG. 10 illustrates a side perspective view of an accessory having an integral accessory attachment system, wherein the accessory is at least partially attached to an accessory attachment portion according to an exemplary embodiment of the present disclosure.
Figure 11:
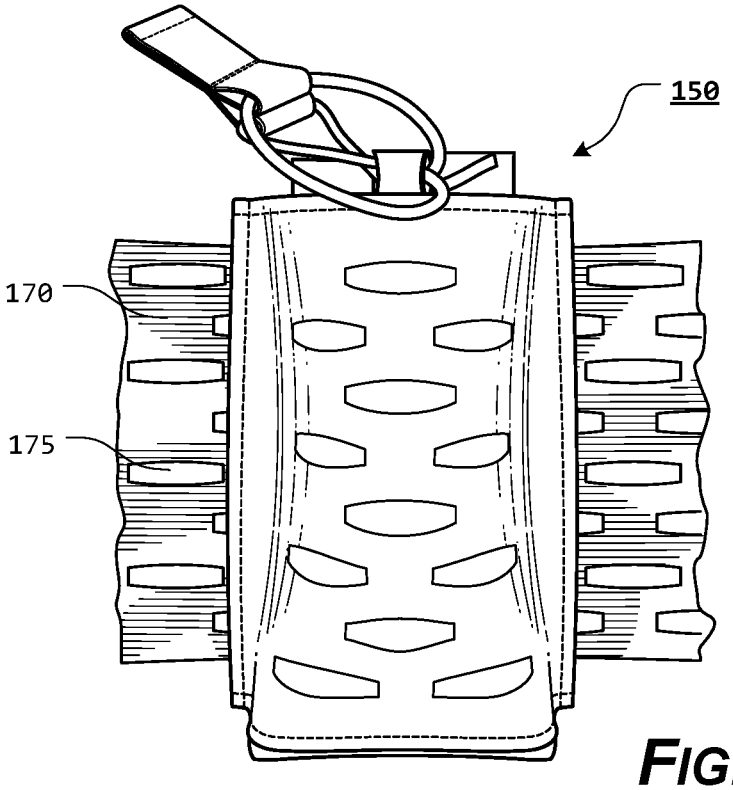
FIG. 11 illustrates a front perspective view of an accessory having an integral accessory attachment system, wherein the accessory is attached to an accessory attachment portion according to an exemplary embodiment of the present disclosure.
Figure 12:
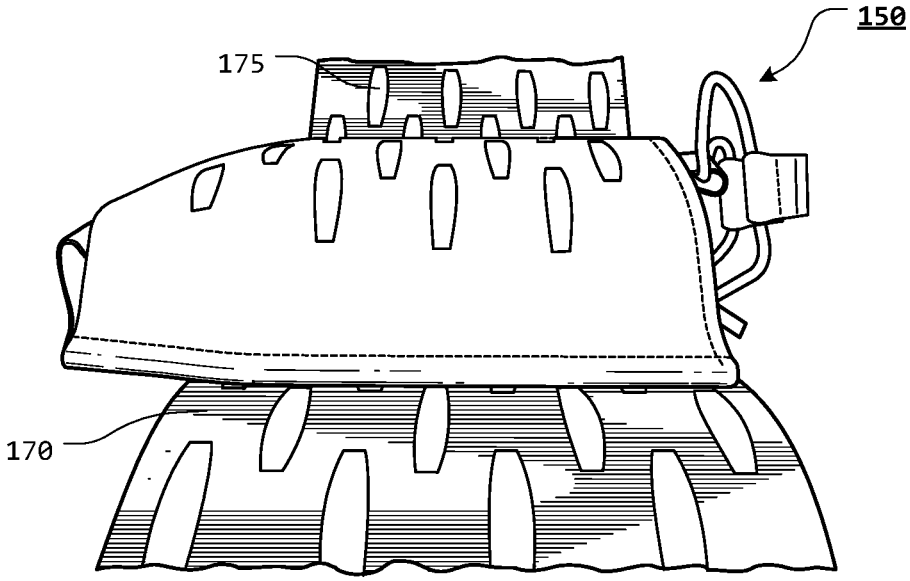
FIG. 12 illustrates a side perspective view of an accessory having an integral accessory attachment system, wherein the accessory is attached to an accessory attachment portion according to an exemplary embodiment of the present disclosure.
Figure 13:
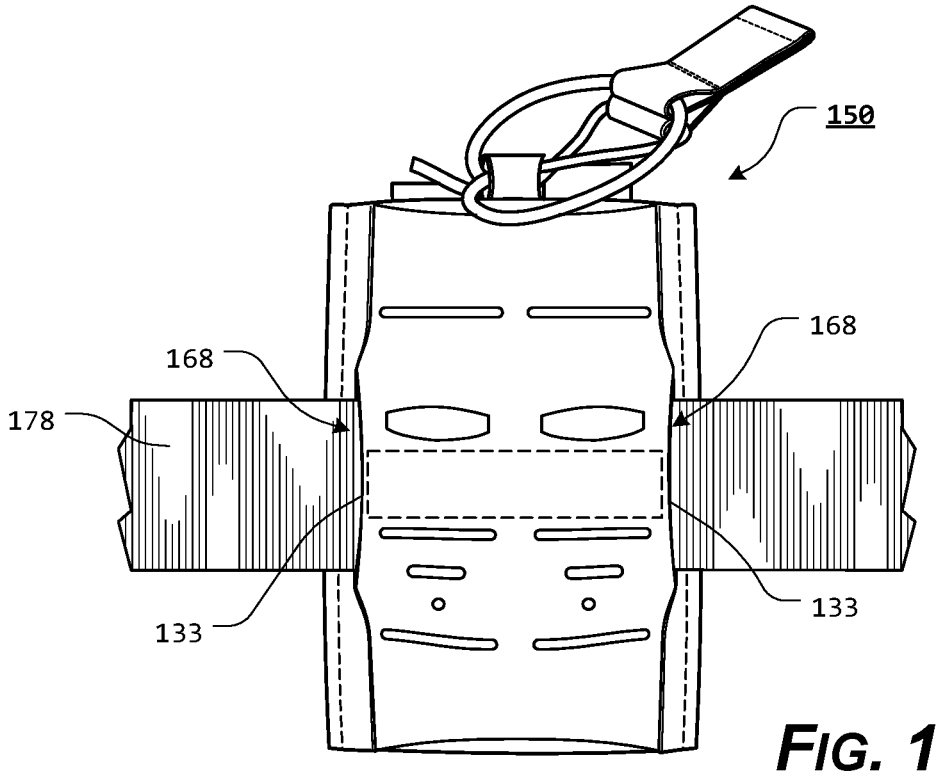
FIG. 13 illustrates a rear perspective view of an accessory having an integral accessory attachment system, attached to an exemplary belt in a substantially vertical orientation, according to an exemplary embodiment of the present disclosure.

For simplicity and clarification, the design factors and operating principles of the integral accessory attachment system according to the present disclosure are explained with reference to various exemplary embodiments of an integral accessory attachment system according to the present disclosure. The basic explanation of the design factors and operating principles of the integral accessory attachment system is applicable for the understanding, design, and operation of the integral accessory attachment system of the present disclosure. It should be appreciated that the integral accessory attachment system can be adapted to many applications where an integral accessory attachment system can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "integral accessory attachment system", "attachment interface layer", "accessory body", and "accessory" are used for basic explanation and understanding of the operation of the systems, methods, and apparatuses of the present disclosure. Therefore, the terms "integral accessory attachment system", "attachment interface layer", "accessory body", and "accessory" are not to be construed as limiting the systems, methods, and apparatuses of the present disclosure.

For simplicity and clarification, the integral accessory attachment system of the present disclosure will be shown and/or described as being used in conjunction with a rear portion or attachment panel of an exemplary accessory pouch being utilized as an exemplary accessory. Furthermore, the integral accessory attachment system of the present disclosure will be shown and/or described as being special coupled to exemplary accessory attachment portion or belt. However, it should be appreciated that these are merely exemplary embodiments of the integral accessory attachment system and are not to be construed as limiting the present disclosure. Thus, the integral accessory attachment system of the present disclosure may be utilized in conjunction with any object or device.

Turning now to the appended drawing figures, FIGS. 1-14 illustrate certain elements and/or aspects of an exemplary embodiment of an integral accessory attachment system 100, according to the presently disclosed systems, methods, and/or apparatuses. In certain illustrative, non-limiting embodiment(s) of the presently disclosed systems, methods, and/or apparatuses, as illustrated in FIGS. 1-14, the integral accessory attachment system 100 comprises at least some of an accessory body 151 having at least one attachment panel 153.

One or more attachment elements 160 extend as an integral extension of a portion of the attachment panel 153 to a terminating portion 162 having a terminating end. Thus, instead of being for that a separate material or separate portion of material that is attached or coupled to the attachment panel 153, each attachment element 160 extends as a continuation of the material used to form the attachment panel 153.

Attachment element notches 164 are defined by recesses formed in opposing side portions of each attachment element 160, proximate the terminating end of each attachment element 160.

Each attachment element notch 164 forms a shoulder 166 proximate the terminating end. A wing portion 165 extends from the shoulder 166 of each attachment element notch 164, toward the terminating end, within the terminating portion 162 of the attachment element 160.

An attachment locking aperture 167 may optionally be formed through a portion of the attachment element 160, proximate the terminal end 161, to further assist in securing the attachment element 160 to the attachment interface layer 130.

In various exemplary embodiments, a bungee retention tab 154 element also extends from the attachment panel 153. The bungee retention tab 154, if included, extends as an integral portion of the attachment panel 153.

In certain exemplary embodiments, the attachment panel 153/attachment element(s) 160 is formed of a portion of a fabric-type or other material, such as, for example, chlorosulfonated polyethylene (CSPE) synthetic rubber (CSM). In certain exemplary embodiments, the attachment panel 153/attachment element(s) 160 is formed of a portion of Hypalon fabric. However, the present disclosure is not so limited. For example, in certain exemplary embodiments, the attachment panel 153/attachment element(s) 160 may be formed of a rigid material, a semi-rigid material, or a substantially flexible material.

In various exemplary, non-limiting embodiments, all or portions of the attachment panel 153/attachment element(s) 160 may be made of any fabric or other material, such as, for example, interwoven fabrics, canvas, acrylics, sheet fabrics, films, nylon, spandex, vinyl, Polyvinyl Chloride (PVC), neoprene, or the like. Alternatively, all or portions of the attachment panel 153/attachment element(s) 160 may be formed from multiple, similar or dissimilar materials. In various exemplary, non-limiting embodiments, the attachment panel 153/attachment element(s) 160 may be water-resistant or may include a cushion material.

It should be appreciated that the terms fabric and material are to be given their broadest meanings and that the particular fabric(s) or material(s) used to form the attachment panel 153/attachment element(s) 160 is a design choice based on the desired appearance and/or functionality of the attachment panel 153/attachment element(s) 160. In general, the material used to form the attachment panel 153/attachment element(s) 160 is selected for its ability to allow the attachment element(s) 160 to be appropriately interwoven between the attachment interface layer 130 and the accessory attachment portion 170.

In various exemplary embodiments, the accessory body 151 further comprises an accessory panel 155 joined to the attachment panel 153, via a connection portion 157.

In various exemplary embodiments, a bungee retention tab 154 element also extends from the accessory panel 155. The bungee retention tab 154, if included, extends as an integral portion of the accessory panel 155.

In this manner, the accessory body 151 comprises a single, integral unit that extends from the terminal end(s) 161 of the one or more attachment elements 160 to a terminal end 161 of the accessory panel 155 (or terminal end of a bungee retention tab 154 that extends from the accessory panel 155).

An attachment interface layer 130 is formed so as to include a plurality of spaced apart attachment slots 135 formed therethrough.

In certain exemplary embodiments, the attachment interface layer 130 is formed of a portion of a fabric-type or other material, such as, for example, chlorosulfonated polyethylene (CSPE) synthetic rubber (CSM). In certain exemplary embodiments, the attachment interface layer 130 is formed of a portion of Hypalon fabric. However, the present disclosure is not so limited. For example, in certain exemplary embodiments, the attachment interface layer 130 may be formed of a rigid material, a semi-rigid material, or a substantially flexible material.

In various exemplary, non-limiting embodiments, all or portions of the attachment interface layer 130 may be made of any fabric or other material, such as, for example, interwoven fabrics, canvas, acrylics, sheet fabrics, films, nylon, spandex, vinyl, Polyvinyl Chloride (PVC), neoprene, or the like. Alternatively, all or portions of the attachment interface layer 130 may be formed from multiple, similar or dissimilar materials. In various exemplary, non-limiting embodiments, the attachment interface layer 130 may be water-resistant or may include a cushion material.

It should be appreciated that the terms fabric and material are to be given their broadest meanings and that the particular fabric(s) or material(s) used to form the attachment interface layer 130 is a design choice based on the desired appearance and/or functionality of the attachment interface layer 130. In general, the material used to form the attachment interface layer 130 is selected for its ability to allow the attachment element(s) 160 to be appropriately interwoven between the attachment interface layer 130 and the attachment panel 153.

The attachment interface layer 130 of the present disclosure is operable with as few as two attachment slots 135. Thus, the size and shape of the attachment interface layer 130 is a design choice, based upon, for example, the size and shape of the portion of attachment interface layer 130 that is desired to potentially accept attachment or coupling of attachment element(s) 160.

In various exemplary embodiments, the attachment slots 135 are generally formed as slots or apertures through the attachment interface layer 130. Each attachment slot 135 is defined by one or more continuous edges.

In various exemplary embodiments, the size of each attachment slot 135 is influenced or dictated by the width of the attachment element(s) 160. For example, if an attachment element 160 has a width of approximately 1 inch, the width of the attachment slots 135 may optionally be slightly greater than approximately 1 inch, so as to allow the attachment element(s) 160 to be appropriately positioned through the attachment slots 135. It should be appreciated that the size and shape of each of the attachment slots 135 is a design choice based upon the desired functionality and/or appearance of the attachment interface layer 130 and the ability of each attachment slot 135 to allow at least a portion of an attachment element 160 to pass therethrough without undue or excess movement or play within each attachment slot 135.

The attachment slots 135 are arranged in a repeating or semi-repeating series or sequence of spaced apart, repeating patterns. In various exemplary embodiments, the attachment slots 135 are arranged in a column 149. The longitudinal axis of the column 149 is parallel to the longitudinal axis of each attachment element 160.

It should be appreciated that two or more adjacent attachment slots 135 may comprise a row 148 and two or more adjacent attachment slots 135 may comprise a column 149. Thus, it should be appreciated that the number of attachment slots 135 formed in the attachment interface layer 130 is a design choice based upon the desired size and/or functionality of the attachment interface layer 130.

By arranging the attachment slots 135 in a repeating or semi-repeating series or sequence, tunnel segments 146 are created between adjacent attachment slots 135 (typically along a longitudinal axis of a column 149).

One or more locking slots 138 are also formed within the column 149 of attachment slots 135. A width of each locking slot 138 corresponds to a width of the attachment element 160 between opposing attachment element notches 164 of a given attachment element 160. The locking slot 138 is typically formed proximate a location where the attachment element notches 164 will be located when the attachment element 160 is folded over the attachment panel 153.

In certain exemplary embodiments, a locking aperture 139 is also formed proximate each locking slot 138. Each locking aperture 139 is formed proximate a location where each attachment locking aperture 167 will rest when the attachment element notches 164 are positioned within the locking slots 138. Alignment of the locking aperture 139 with the attachment locking aperture 167 allows an additional fastening element to be positioned through the aligned attachment locking aperture 167 and locking aperture 139 to further secure the terminating portion 162 of the attachment element 160 to the attachment interface layer 130.

The attachment interface layer 130 is illustrated as comprising a somewhat rectangular portion of material that is at least partially attached or coupled the attachment panel 153 portion of the accessory body 151. As illustrated, the attachment interface layer 130 is attached or coupled to a portion of the accessory body 151 by attachment interface layer attachment elements 132, such as stitching proximate a perimeter of the attachment interface layer 130 and a perimeter of the attachment panel 153 portion of the accessory body 151.

In certain exemplary embodiments, the attachment interface layer attachment elements 132 comprise stitching. Alternatively, the attachment interface layer 130 may be attached or coupled to the attachment panel 153 at one or more attachment interface layer attachment elements 132 via adhesive bonding, welding, screws, rivets, pins, mating hook and loop portions, snap or releasable fasteners, or other known or later developed means or methods for permanently or releasably attaching or coupling the attachment interface layer 130 to the attachment panel 153.

In addition to the variability of size and shape of the attachment interface layer 130, the orientation of the attachment interface layer 130, relative to the attachment panel 153, is also a design choice. Thus, while the attachment interface layer 130 is illustrated as being attached or coupled to the attachment panel 153, such that the columns 149 of attachment slots 135 are substantially parallel to the longitudinal axis, along the length, of the attachment panel 153, it should be appreciated that this is merely exemplary and the attachment interface layer 130 may be attached at any desired angular or rotational orientation relative to an attachment panel 153.

The portions of material of the attachment interface layer 130 between adjacent attachment slots 135 form tunnel segments 146. If the attachment interface layer 130 is attached to an attachment panel 153, the tunnel segments 146 are formed between the attachment interface layer 130 and the surface of the attachment panel 153. The tunnel segments 146 provide areas for securing the attachment element 160 of an accessory 150 to the attachment interface layer 130. In this manner, an attachment element 160 may be interwoven between the aligned tunnel segments 146 to removably attach the accessory 150 to the attachment interface layer 130.

Figure 15:
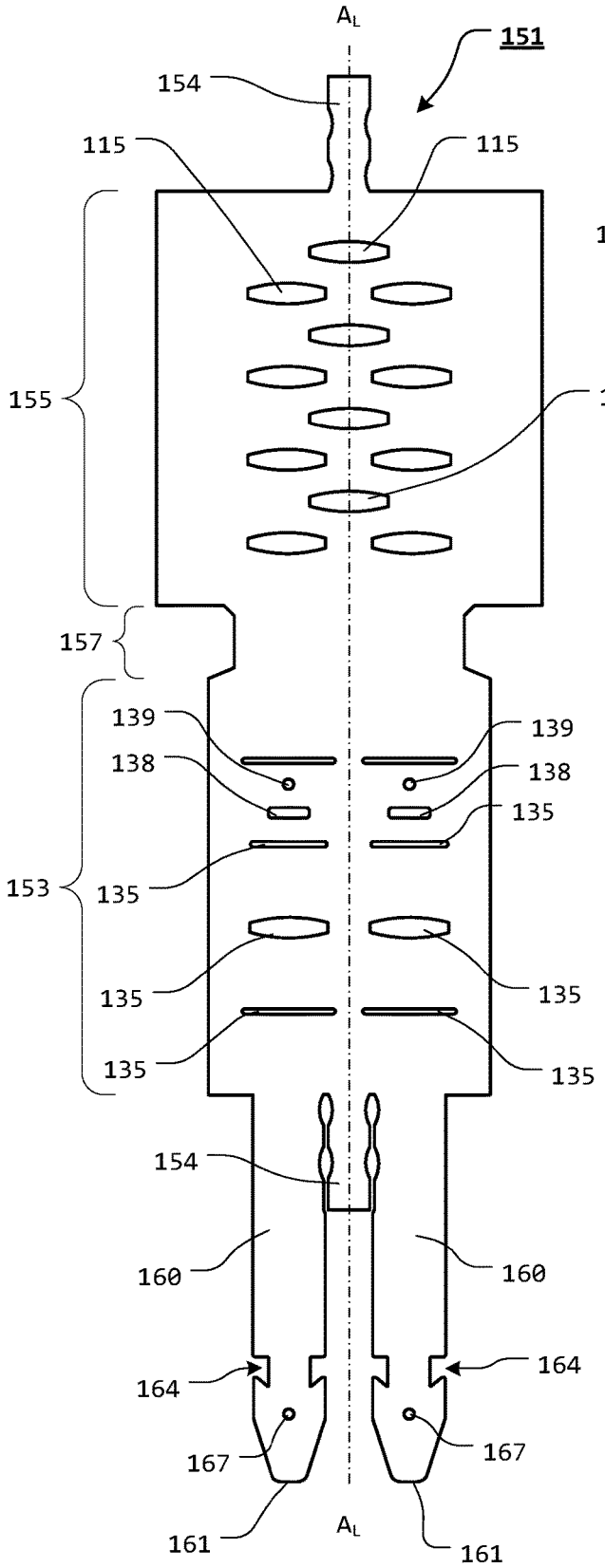
FIG. 15 illustrates a front view of an exemplary embodiment of an accessory body having an integral accessory attachment system, according to the present disclosure.
Figure 16:
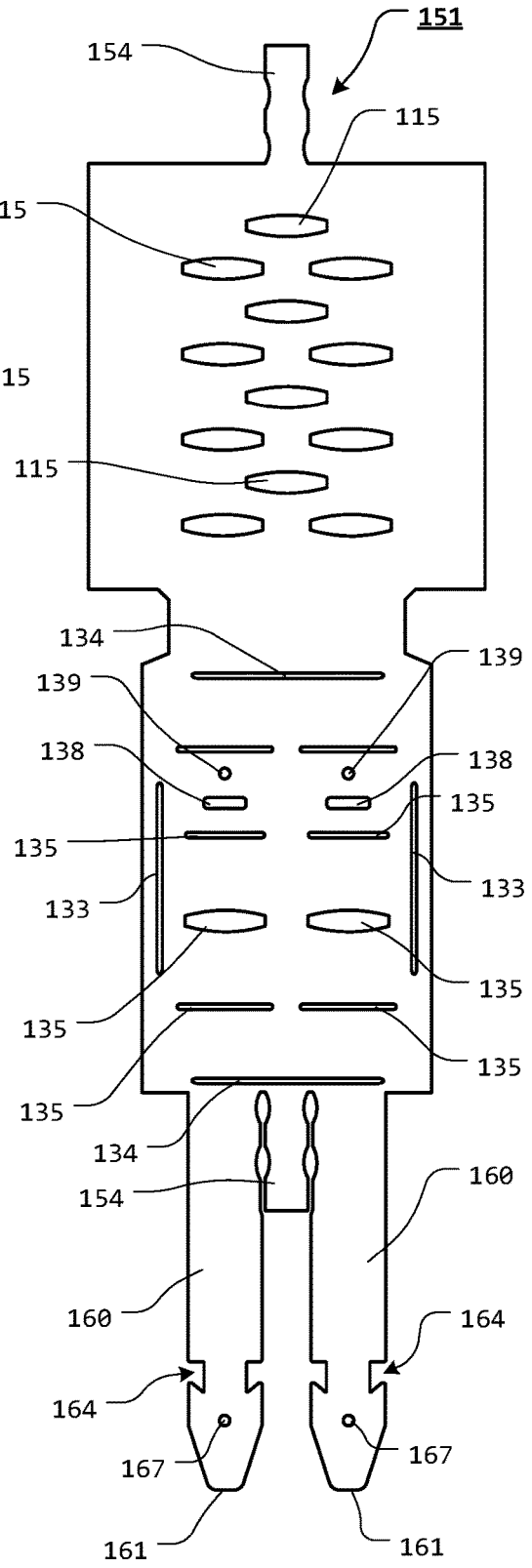
FIG. 16 illustrates a front view of an exemplary embodiment of an accessory body having an integral accessory attachment system, according to the present disclosure.
Figure 17:
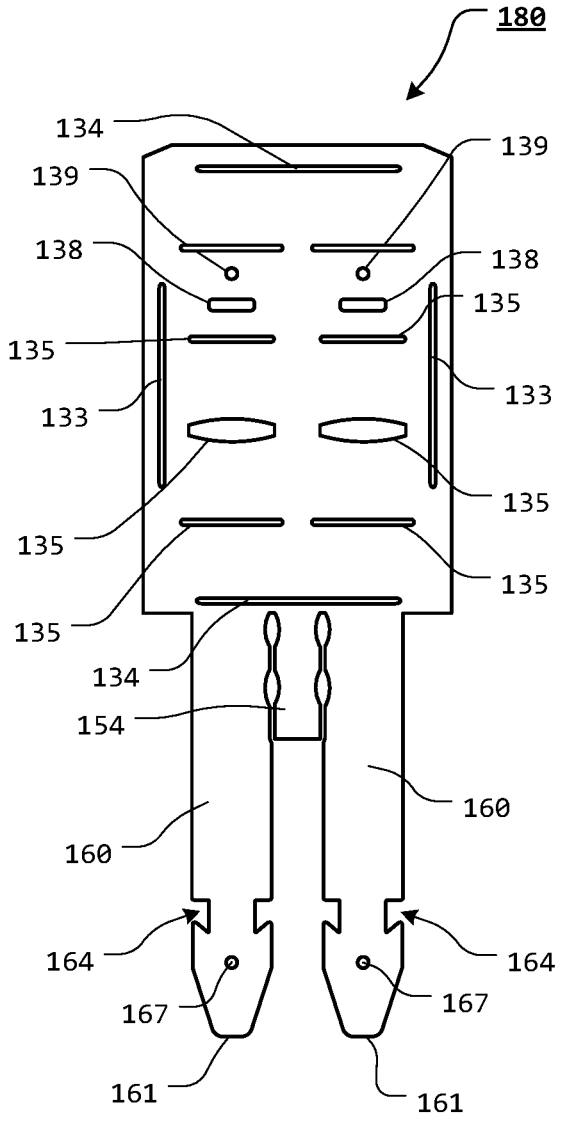
FIG. 17 illustrates a front view of an exemplary embodiment of an accessory backing portion having an integral accessory attachment system, according to the present disclosure.

In various exemplary embodiments, as illustrated FIGS. 1-14, the attachment interface layer 130 comprises a standalone element, such as, for example, a sheet of attachment interface layer 130 material, which is attached or coupled within the attachment panel 153 of the accessory body 151. However, in various exemplary embodiments, as illustrated in FIGS. 15-17, the attachment slots 135, locking slot 138, and optional locking aperture 139, are formed as an integral component of the attachment panel 153.

The accessory body 151 is formed so as to be folded, along the connection portion 157, such that the accessory panel 155 can be attached or coupled to at least a portion of the attachment panel 153. Typically, outer surface edges or edge portions of the accessory panel 155 are attached or coupled, via attachment interface layer attachment elements 132 (such as, for example, by stitching), to outer surface edges were edge portions of the attachment panel 153 to form a cavity 152 of the accessory body 151, as illustrated in FIGS. 2-14.

In certain illustrative, non-limiting embodiment(s) of the present disclosure, the attachment interface layer 130 overlays at least a portion of the attachment panel 153 and is attached or coupled, at one or more attachment points/areas to a portion of the attachment panel 153. In various exemplary embodiments, the attachment points/areas are located proximate four corner portions of the attachment interface layer 130. However, it should be appreciated that the number and placement of the attachment points/areas is a design choice and the attachment points/areas may be formed at any desired location relative to the attachment panel 153 and the attachment interface layer 130.

Once appropriately attached or coupled to the attachment panel 153, an upper vertical tunnel notch 134 is formed between adjacent upper attachment points/areas and a lower vertical tunnel notch 134 is formed between adjacent lower attachment points/areas. A vertical tunnel 169 is formed between the upper vertical tunnel notch 134 and the lower vertical tunnel notch 134. In certain exemplary embodiments, at least a portion of the vertical tunnel 169 is formed between a rear surface of the attachment interface layer 130 and an outer surface of the attachment panel 153.

Similarly, a right horizontal tunnel notch 133 is formed between adjacent upper and lower attachment points/areas proximate a right side of the attachment interface layer 130 and a left horizontal tunnel notch 133 is formed between adjacent upper and lower attachment points/areas proximate a left side of the attachment interface layer 130. A horizontal tunnel 168 is formed between the right horizontal tunnel notch 133 and the left horizontal tunnel notch 133. In certain exemplary embodiments, at least a portion of the horizontal tunnel 168 is formed between a rear surface of the attachment interface layer 130 and an outer surface of the attachment panel 153.

Thus, the attachment interface layer 130 overlays at least a portion of the attachment panel 153 and is attached or coupled to the attachment panel 153 to define an upper vertical tunnel notch 134 proximate an upper end of the attachment interface layer 130, a lower vertical tunnel notch 134 proximate a lower end of the attachment interface layer 130, a right horizontal tunnel notch 133 proximate a right side of the attachment interface layer 130, and a left horizontal tunnel notch 133 proximate the left side of the attachment interface layer 130, wherein a vertical tunnel 169 is formed between the upper vertical tunnel notch 134 and the lower vertical tunnel notch 134, and wherein a horizontal tunnel 168 is formed between the right horizontal tunnel notch 133 and the left horizontal tunnel notch 133.

In certain exemplary, nonlimiting embodiments, a longitudinal axis of the horizontal tunnel 168 and a longitudinal axis of the vertical tunnel 169 are offset by approximately 90°. Alternatively, a longitudinal axis of the horizontal tunnel 168 and a longitudinal axis of the vertical tunnel 169 are offset by an obtuse or an acute angle.

The attachment interface layer 130 is generally attached or coupled to the attachment panel 153 such that a longitudinal axis of the horizontal tunnel 168 is perpendicular to a longitudinal axis of the attachment panel 153 and a longitudinal axis of the vertical tunnel 169 it is parallel to a longitudinal axis of the attachment panel 153. However, it should be appreciated that this orientation is merely exemplary and not limiting. Thus, the attachment interface layer 130 may be attached or coupled to the attachment panel 153 such that the longitudinal axis of the horizontal tunnel 168 is positioned at any desired angular orientation relative to the attachment panel 153 and the longitudinal axis of the vertical tunnel 169 is positioned at any desired angular orientation relative to the attachment panel 153.

In certain exemplary, nonlimiting embodiments, the upper vertical tunnel notch 134 is separated from the lower vertical tunnel notch 134 by a distance that is equal to or less than a length of the attachment interface layer 130. Thus, the upper vertical tunnel notch 134 is formed at or by an upper edge of the attachment interface layer 130 and the lower vertical tunnel notch 134 is formed at or by a lower edge of the attachment interface layer 130. Alternatively, the upper vertical tunnel notch 134 and the lower vertical tunnel notch 134 may optionally be formed through a portion of the attachment interface layer 130 and not formed at an upper edge or lower edge of the attachment interface layer 130, respectively.

In certain exemplary embodiments, as illustrated in FIGS. 16-17, the attachment slots 135, blocking slot 138, and optional locking aperture 139 are formed as an integral portion of the attachment panel 153. In these exemplary embodiments, the upper vertical tunnel notch 134, the lower vertical tunnel notch 134, the right horizontal tunnel notch 133, and the left horizontal tunnel notch 133 may comprise holes or aperture formed through a portion of the attachment panel 153.

Figure 14:
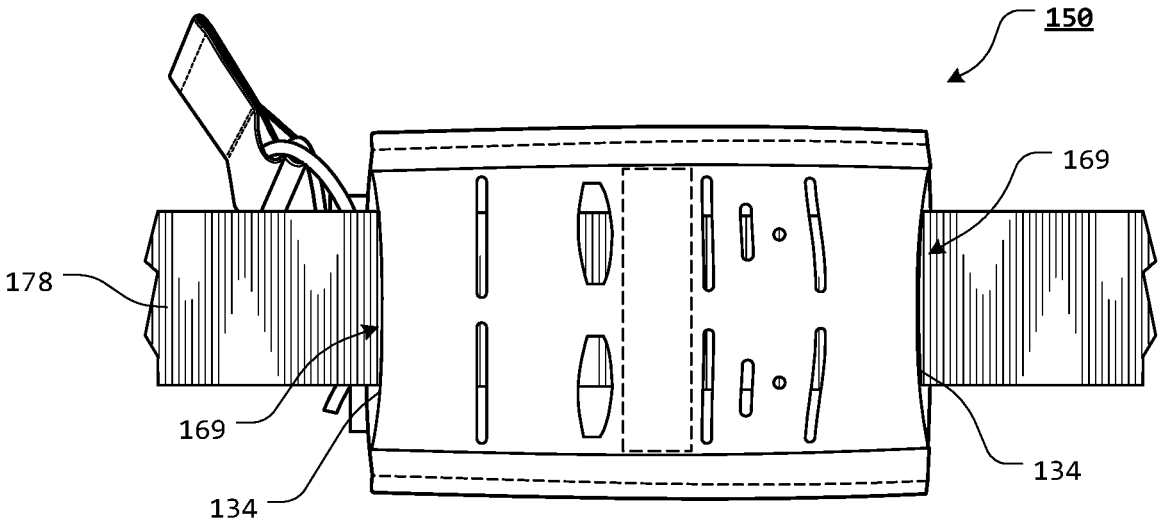
FIG. 14 illustrates a rear perspective view of an accessory having an integral accessory attachment system, attached to an exemplary belt in a substantially horizontal orientation, according to an exemplary embodiment of the present disclosure.

During attachment of an exemplary accessory 150 to an exemplary belt 178, the accessory 150 may optionally be attached to the belt 178 in a substantially vertical manner (as illustrated most clearly in FIG. 13) or may optionally be attached to the belt 178 in a substantially horizontal orientation (as illustrated most clearly in FIG. 14). If it is desired to attach the accessory 150 to the belt 178 in a substantially vertical manner, the belt 178 is aligned with a horizontal tunnel aperture (either the left horizontal tunnel notch 133 or the right horizontal tunnel notch 133), urged through the aligned horizontal tunnel aperture, and interwoven or threaded through the horizontal tunnel 168 until the belt 178 exits the opposite horizontal tunnel aperture (either the right horizontal tunnel notch 133 or the left horizontal tunnel notch 133). If the belt 178 is positioned such that a longitudinal axis of the belt 178 is substantially horizontal, the accessory 150 will be attached or coupled to the belt 178 in a substantially vertical orientation.

If it is desired to attach the accessory 150 to the belt 178 in a substantially horizontal orientation, the belt 178 is aligned with a vertical tunnel aperture (either the upper vertical tunnel notch 134 or the lower vertical tunnel notch 134), urged through the aligned vertical tunnel aperture, and interwoven or threaded through the vertical tunnel 169 until the belt 178 exits the opposite vertical tunnel aperture (either the lower vertical tunnel notch 134 or the upper vertical tunnel notch 134). If the belt 178 is positioned such that a longitudinal axis of the belt 178 is substantially horizontal, the accessory 150 will be attached or coupled to the belt 178 in a substantially horizontal orientation.

It should be understood that these orientations are relative to the orientation of the accessory 150 relative to the belt 178.

In various exemplary embodiments, the accessory 150 includes an accessory interface layer 110. If included, the accessory interface layer 110 includes a plurality of spaced apart accessory apertures 115 formed therethrough.

The portions of material of the accessory interface layer 110 between adjacent accessory apertures 115 form tunnel segments 146. If the accessory interface layer 110 is attached to an accessory panel 155 portion of the accessory body 151, the tunnel segments 146 are formed between the accessory interface layer 110 and the surface of the accessory panel 155. The tunnel segments 146 provide areas for securing an accessory 150 to the accessory interface layer 110. In this manner, a separate attachment element 160 may be interwoven between the aligned tunnel segments 146 to removably attach an additional or alternative accessory 150 to the accessory interface layer 110.

In certain exemplary embodiments, the accessory interface layer 110 is formed of a portion of a fabric-type or other material, such as, for example, chlorosulfonated polyethylene (CSPE) synthetic rubber (CSM). In certain exemplary embodiments, the accessory interface layer 110 is formed of a portion of Hypalon fabric. However, the present disclosure is not so limited. For example, in certain exemplary embodiments, the accessory interface layer 110 may be formed of a rigid material, a semi-rigid material, or a substantially flexible material.

In various exemplary, non-limiting embodiments, all or portions of the accessory interface layer 110 may be made of any fabric or other material, such as, for example, interwoven fabrics, canvas, acrylics, sheet fabrics, films, nylon, spandex, vinyl, Polyvinyl Chloride (PVC), neoprene, or the like. Alternatively, all or portions of the accessory interface layer 110 may be formed from multiple, similar or dissimilar materials. In various exemplary, non-limiting embodiments, the accessory interface layer 110 may be water-resistant or may include a cushion material.

As a further example, in certain exemplary embodiments, the accessory interface layer 110 may be formed of a substantially rigid material, such as plastic, having an appropriate, workable thickness. Alternate materials of construction of the accessory interface layer 110 may include one or more of the following: steel, stainless steel, aluminum, titanium, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, interwoven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the accessory interface layer 110 is a design choice based on the desired appearance and functionality of the accessory interface layer 110.

It should be appreciated that the terms fabric and material are to be given their broadest meanings and that the particular fabric(s) or material(s) used to form the accessory interface layer 110 is a design choice based on the desired appearance and/or functionality of the accessory interface layer 110. In general, the material used to form the accessory interface layer 110 is selected for its ability to allow the attachment element(s) 160 to be appropriately interwoven between the accessory interface layer 110 and the accessory attachment portion 170.

As illustrated, the accessory interface layer 110 includes an accessory interface layer 110 having two or more accessory apertures 115 formed therethrough at spaced apart locations and arranged in one or more rows 148 and/or columns 149. The accessory interface layer 110 is at least partially attached or coupled to an accessory panel 155 and tunnel segments 146 are formed between adjacent accessory apertures 115.

The accessory interface layer 110 of the present disclosure is operable with as few as two accessory apertures 115. Thus, the size and shape of the accessory interface layer 110 is a design choice, based upon, for example, the size and shape of the accessory panel 155 or portion of accessory panel 155 that is desired to potentially accept attachment or coupling of additional accessories.

In various exemplary embodiments, the accessory apertures 115 are generally formed as apertures through the accessory interface layer 110. Each accessory aperture 115 is defined by one or more continuous edges or edge portions and is defined by a first height, H1, a second height, H2, and a first width, W1. Each accessory aperture 115 is formed of two substantially equal length, parallel aperture sides 116, each having a height, H2. It should be appreciated that the width, W1, between of each of the aperture sides 116 is a design choice based upon the desired functionality and/or appearance of the accessory aperture 115.

An arcuate side 117 joins respective upper terminal ends 161 and respective lower terminal ends 161 of each of the aperture sides 116. In various exemplary embodiments, the height, H1, is formed between apexes of each of the aperture sides 116. It should be appreciated that the height, H1, between apexes of each of the aperture sides 116 is a design choice based upon the desired functionality and/or appearance of the accessory aperture 115. Thus, the angle of each arc forming each arcuate side 117 may be formed based upon the desired functionality and/or appearance of each accessory aperture 115.

Each accessory aperture 115 is generally formed as an aperture or hole through the accessory interface layer 110. It is possible for the accessory interface layer 110 to be formed as an integral part of the accessory panel 155 of the accessory body 151. However, in various exemplary embodiments, the accessory interface layer 110 is at least partially attached or coupled to at least a portion of a carrier or carrier material, such as, for example, an accessory panel 155. Thus, the accessory interface layer 110 may be at least partially attached or coupled to an accessory panel 155.

The overall size of each accessory aperture 115 is also a design choice. In certain exemplary embodiments, the size of each accessory aperture 115 is influenced or dictated by the width of the accessory coupling element of a compatible accessory 150. For example, if the accessory coupling element has a width of approximately 1 inch, the width, W1, between of each of the aperture sides 116 may optionally be approximately 1 inch, so as to allow the accessory coupling element to be fitted within and interwoven between two or more accessory apertures 115. Alternatively, the width, W1, between of each of the aperture sides 116 may be such that only certain accessories are compatible with the accessory interface layer 110 and the accessory 150.

The accessory apertures 115 may be arranged in a repeating or semi-repeating series or sequence of spaced apart, repeating patterns. In various exemplary embodiments, the accessory apertures 115 are arranged in a repeating or semi-repeating series or sequence of spaced apart rows 148 and columns 149. In various exemplary embodiments, the accessory apertures 115 are arranged in a series of equally spaced rows 148 and equally spaced columns 149.

In certain exemplary embodiments, each of the rows 148 is spaced at a distance that is the same as the spacing between each of the columns 149. Alternatively, the spacing between each of the rows 148 is greater than or less than the spacing between each of the columns 149.

In various exemplary embodiments, the spacing between either edges or proximate centers of adjacent accessory apertures 115 (whether vertically, horizontally, obliquely, or diagonally adjacent) is influenced or dictated by the width of the accessory webbing element of a compatible accessory 150. For example, if the accessory webbing element has a width of approximately 1 inch, the spacing between either edges or proximate centers of adjacent accessory apertures 115 may optionally be approximately 1 inch, so as to allow the accessory webbing element to be appropriately aligned between every other accessory aperture 115 in a vertical, horizontal, oblique, or diagonal direction. Alternatively, the spacing between either edges or proximate centers of adjacent accessory apertures 115 may be created such that only certain accessories are compatible with the accessory interface layer 110 and the accessory 150.

It should be appreciated that two or more adjacent accessory apertures 115 may comprise a row 148 and two or more adjacent accessory apertures 115 may comprise a column 149. Thus, it should be appreciated that the number of accessory apertures 115 formed in the accessory interface layer 110 is a design choice based upon the desired size and/or functionality of the accessory interface layer 110.

In various exemplary, nonlimiting embodiments, each adjacent row 148 and/or column 149 of spaced apart accessory apertures 115 is offset such that either edges or proximate centers of adjacent accessory apertures 115 are offset by approximately ±45°, approximately ±33°, or approximately ±90°. If for example, either edges or proximate centers of adjacent accessory apertures 115 are offset by ±45°, ±33°, or ±90°, an attached or coupled compatible accessory 150 may be attached or coupled at least at ±0°, ±90°, ±33°, or ±45°. Thus, it should be appreciated that the offset of adjacent rows 148 and/or columns 149 dictates the angle of oblique attachment of accessories.

In certain exemplary, nonlimiting embodiments, each accessory aperture 115 may be separated from each other accessory aperture 115 by a distance that is equal to or greater than a width of each accessory aperture 115. Alternatively, each accessory aperture 115 may be separated from each other accessory aperture 115 by a distance that is equal to or greater than a width of each accessory aperture 115.

By arranging the accessory apertures 115 in a repeating or semi-repeating series or sequence, aperture array tunnel segments 146 are created between adjacent accessory apertures 115 (whether vertically, horizontally, obliquely, acutely, or diagonally adjacent).

In various exemplary, nonlimiting embodiments, the accessory interface layer 110 comprises a portion of accessory interface layer 110 material that is at least partially attached or coupled to the accessory panel 155 by attachment interface layer attachment elements 132, such as stitching proximate a perimeter of the accessory interface layer 110. The accessory interface layer 110 may optionally be attached or coupled or further attached or coupled to the accessory panel 155, via additional attachment interface layer attachment elements 132. The attachment interface layer attachment elements 132 may be spaced apart, as necessary or desirable, in order to further secure, attach, or couple the accessory interface layer 110 to the accessory panel 155. The number and placement of additional attachment interface layer attachment elements 132 is a design choice based upon the desired level of securement of the accessory interface layer 110 to the accessory panel 155 and/or to further ensure that the accessory interface layer 110 will not separate or pull away from the accessory panel 155, particularly if accessories are attached or coupled to the accessory interface layer 110.

In certain exemplary embodiments, the attachment interface layer attachment elements 132 comprise stitching. Alternatively, the accessory interface layer 110 may be attached or coupled to the accessory panel 155 at one or more attachment interface layer attachment elements 132 via adhesive bonding, welding, screws, rivets, pins, mating hook and loop portions, snap or releasable fasteners, or other known or later developed means or methods for permanently or releasably attaching or coupling the accessory interface layer 110 to the accessory panel 155. The one or more attachment interface layer attachment elements 132 may be formed or positioned proximate a perimeter of the accessory interface layer 110 or in one or more areas located within the attachment interface layer 130.

In addition to the variability of size and shape of the accessory interface layer 110, the orientation of the accessory interface layer 110, relative to the accessory panel 155, is also a design choice. Thus, the accessory interface layer 110 may optionally be attached or coupled to the accessory panel 155, such that the rows 148 of accessory apertures 115 are substantially parallel to a longitudinal or other axis, along the length, of the exemplary accessory panel 155, while the columns 149 of accessory apertures 115 are substantially perpendicular to the longitudinal or other axis of the accessory panel 155. It should be appreciated that this is merely exemplary and the accessory interface layer 110 may be attached at any desired angular or rotational orientation relative to the accessory panel 155.

The portions of material of the accessory interface layer 110 between adjacent accessory apertures 115 form aperture array tunnel segments 146. If the accessory interface layer 110 is attached to the accessory panel 155, the aperture array tunnel segments 146 are formed between at least portions of the accessory interface layer 110 and at least portions of the surface of the accessory panel 155. The aperture array tunnel segments 146 provide areas for securing the accessory webbing elements of a compatible accessory 150 to the accessory interface layer 110. In this manner, an accessory coupling element may be interwoven between the aligned aperture array tunnel segments 146 to removably attach the compatible accessory 150 to the accessory panel 155.

It should be appreciated that a more detailed explanation of the instructions regarding how to interweave the accessory coupling element between the accessory apertures 115 and accessory webbing elements is not provided herein because, while the accessory interface layer 110 provides more orientation options and other features, accessories are generally attached to the accessory interface layer 110 in a manner similar to the manner in which accessories are attached to a portion of MOLLE webbing. Therefore, it is believed that the level of description provided herein is sufficient to enable one of ordinary skill in the art to understand and practice the systems, methods, and apparatuses, as described.

During assembly, the accessory interface layer 110 is positioned atop a portion of the accessory panel 155 and the attachment interface layer 130 is positioned atop a portion of the attachment panel 153. The aligned attachment panel 153, attachment interface layer 130, accessory panel 155, and accessory interface layer 110 are folded along the connection portion 157. The attachment interface layer 130 is attached or coupled to a portion of the accessory body 151 by attachment interface layer attachment elements 132, proximate a perimeter of the attachment interface layer 130 and a perimeter of the attachment panel 153 portion of the accessory body 151. In this manner, a cavity 152 is formed in the accessory body 151, having an open top end 158 defined by a top portion of the accessory panel 155 and a bottom end 159 defined by the connection portion 157.

The bungee retention tabs 154 may optionally be folded and attached or coupled to portions of the accessory panel 155 and/or attachment panel 153, respectively to form tabs for securing bungee cord 156 across at least a portion of the open top end 158 of the cavity 152.

As illustrated most clearly in FIGS. 8-12, the accessory 150 may be attached or coupled to an accessory attachment portion 170, via interaction of accessory attachment apertures 175 of the accessory attachment portion 170 and the attachment element(s) 160. Initially, each attachment element 160 extending from the attachment panel 153 is aligned with an appropriate accessory attachment aperture 175. The terminal end 161 of each attachment element 160 is initially urged through an accessory attachment aperture 175, into a tunnel segment 146 of the accessory attachment portion 170, and out of a subsequent accessory attachment aperture 175.

The terminal and is then urged through an attachment slot 135 associated with the attachment panel 153, into a tunnel segment 146 of the attachment interface layer 130, and out of a subsequent attachment slot 135. The interweaving of the terminal and of the attachment element 160 continues through subsequent accessory attachment apertures 175, accessory attachment tunnel segments 146, attachment slots 135, and attachment slot 135 tunnel segments 146, until the terminal end 161 of the attachment element 160 is positioned proximate a locking slot 138 of the attachment interface layer 130 (as illustrated, for example, in FIG. 8, wherein the attachment elements 160 are shown interwoven without attachment to an accessory attachment portion 170).

The terminal end 161 is then urged through the locking slot 138 and the wing portions 165 of the attachment element 160 are folded or manipulated so as to be urged through the locking slot 138. Once the wing portion 165 or shoulders 166 of the attachment element notches 164 exit the locking slot 138, the shoulders 166 interact with the locking slot 138 so as to provide resistance to a withdrawing force of the attachment element 160 from the locking slot 138.

It is believed that the level of description provided herein for interweaving the attachment element 160 between the attachment slots 135 and accessory attachment apertures 175 is sufficient to enable one of ordinary skill in the art to understand and practice the systems, methods, and apparatuses, as described.

As illustrated in FIG. 17, the present disclosure optionally provides a backing portion 180 for an accessory 150. In this manner, the backing portion 180 can be utilized with other elements to be attached or coupled using the attachment elements 160 of the present disclosure.

Figure 18:
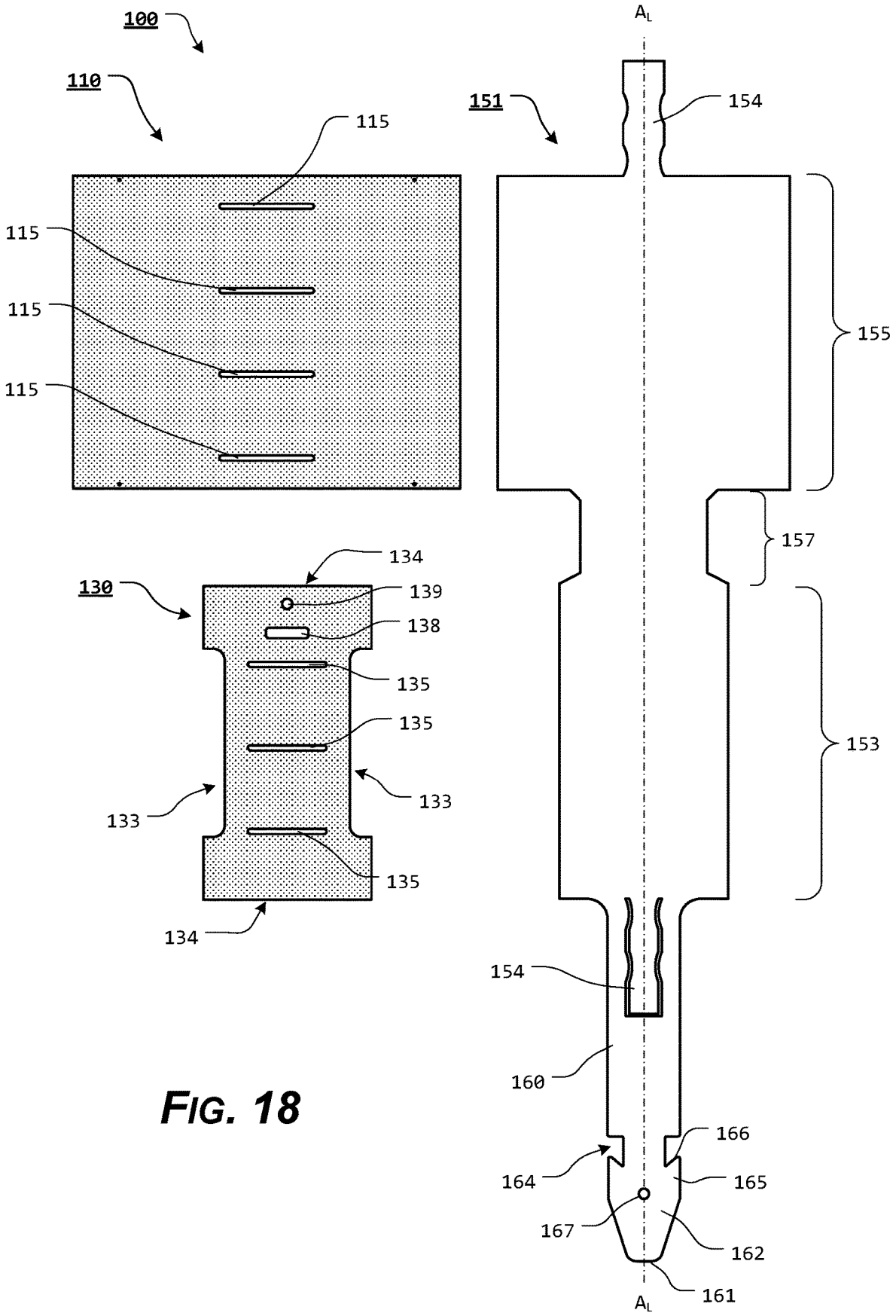
FIG. 18 illustrates a front view of certain exemplary components of an exemplary embodiment of an integral accessory attachment system, according to the present disclosure.

As illustrated in FIG. 18, the accessory body 151 may be formed so as to include a single attachment element 160 extending from the attachment panel 153. Additionally, a single column 149 of attachment slots 135 and at least one locking slot 138 are provided either as a separate attachment interface layer 130 or formed integral to the attachment panel 153, as described and illustrated herein.

Figure 19:
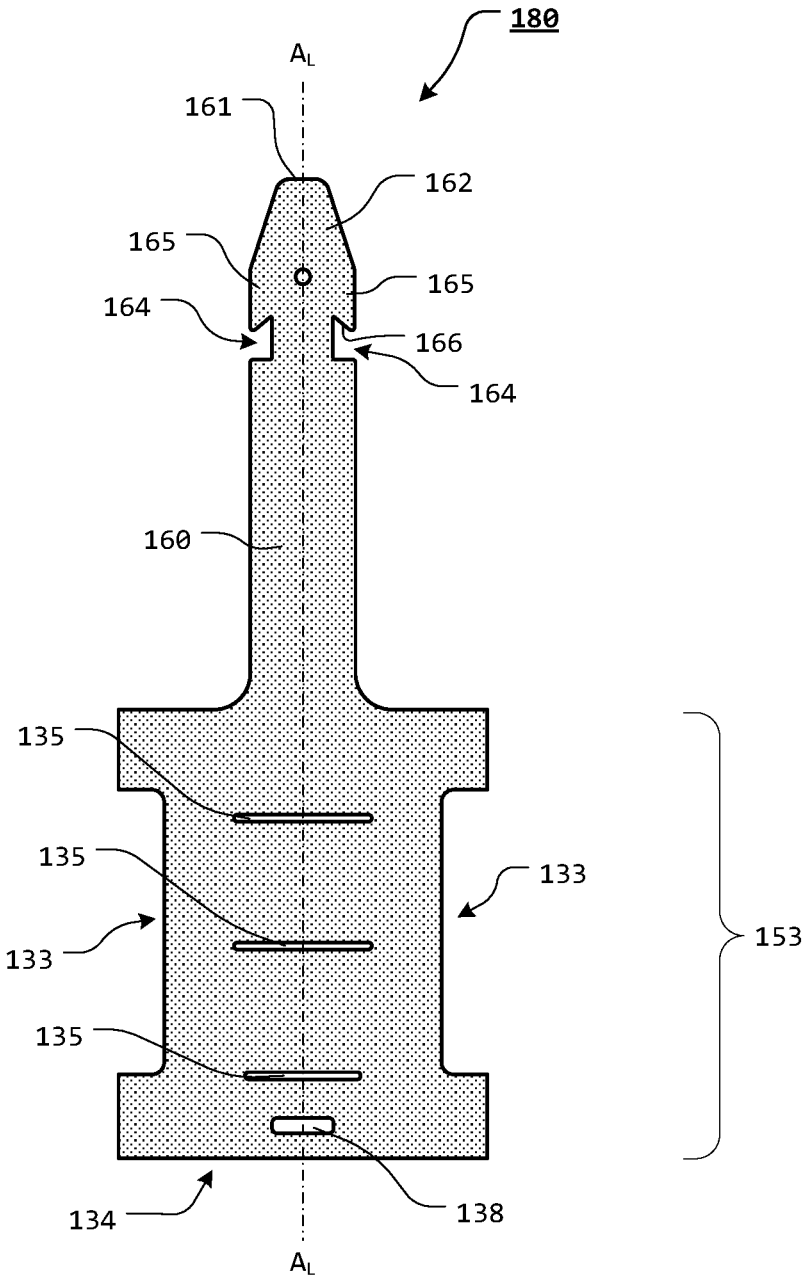
FIG. 19 illustrates a front view of an exemplary embodiment of an accessory backing portion having an integral accessory attachment system, according to the present disclosure.
Figure 20:
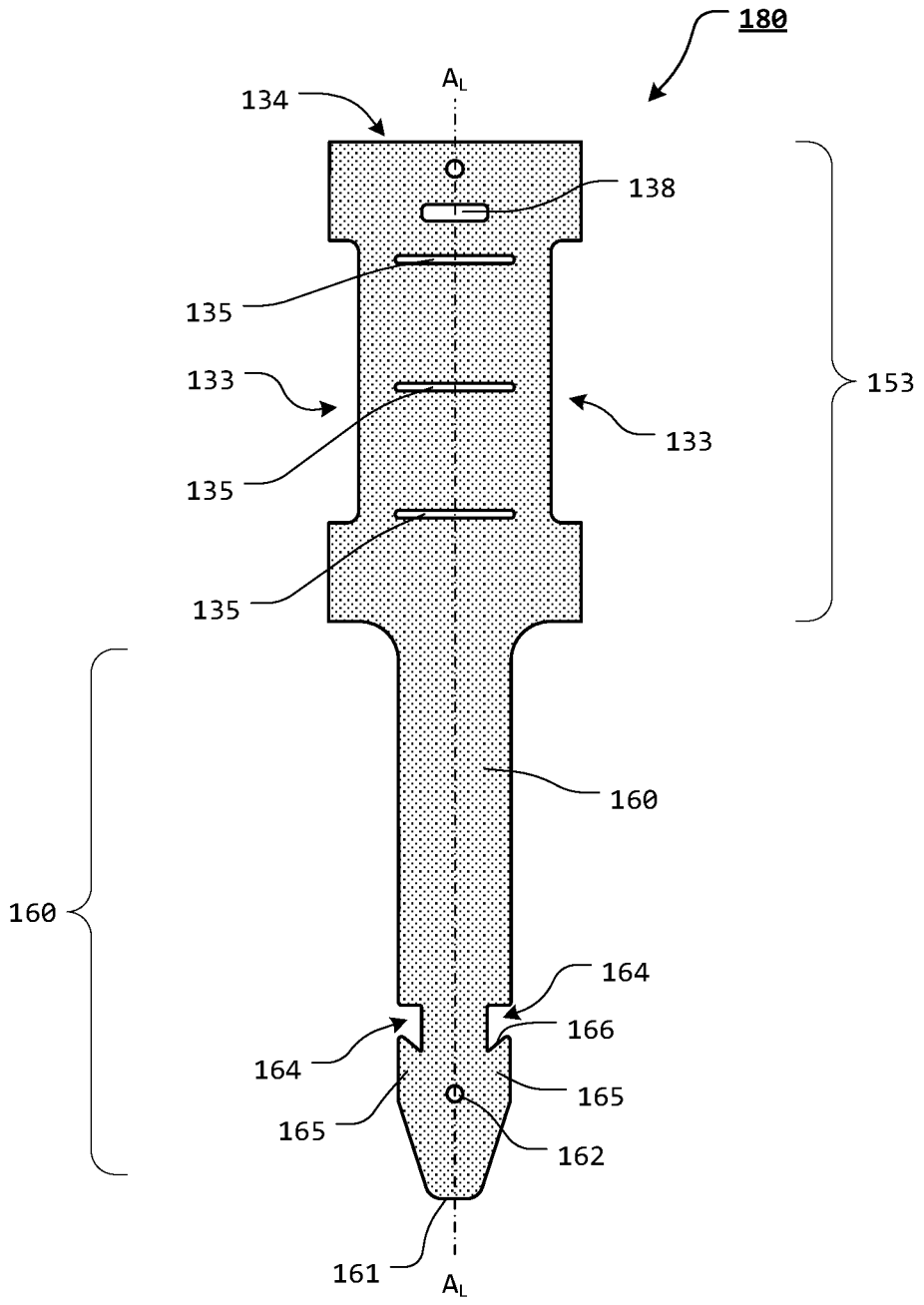
FIG. 20 illustrates a front view of an exemplary embodiment of an accessory backing portion having an integral accessory attachment system, according to the present disclosure.

As illustrated in FIGS. 19 and 20, the present disclosure optionally provides a backing portion 180 for an accessory 150. In this manner, the backing portion 180 can be attached or coupled to an accessory 150 (such as, for example, a holster, pouch, carrier, etc.) so as to be utilized to attach or coupled the accessory 150 using the attachment elements 160 of the present disclosure. In these exemplary embodiments, the elements of the attachment interface layer 130 (such as, for example, the attachment slots 135, locking slot 138, optional locking aperture 139, horizontal tunnel notches 133, vertical tunnel notches 134, etc.) are formed integral to the attachment panel 153.

When the attachment panel 153 of the backing portion 180 is attached or coupled to the accessory 150, the accessory 150 can be attached or coupled to at least a portion of a carrier or carrier material, as described herein.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An integral accessory attachment system, comprising:

an accessory body having an accessory panel, a connection portion, and an attachment panel, wherein one or more attachment elements extend as an integral extension of a portion of said attachment panel; and an attachment interface layer, wherein said attachment interface layer is at least partially attached or coupled to at least a portion of said attachment panel, wherein a plurality of attachment slots are provided through at least a portion of said attachment interface layer, and wherein at least one locking slot is formed through said attachment interface layer such that at least a portion of said attachment element is positionable through at least one attachment slot and wherein attachment element notches of said attachment element are positionable within said locking slot.

2. The integral accessory attachment system of claim 1, wherein said attachment element notches comprise opposing attachment element notches formed in a portion of said attachment element and define a narrowed portion of said attachment element.

3. The integral accessory attachment system of claim 1, wherein an accessory interface layer is attached or coupled to at least a portion of said accessory panel.

4. The integral accessory attachment system of claim 3, wherein a plurality of accessory apertures are formed through said accessory interface layer.

5. The integral accessory attachment system of claim 4, wherein said accessory apertures are formed in a repeating or semi-repeating pattern.

6. The integral accessory attachment system of claim 4, wherein said accessory apertures are formed in a repeating or semi-repeating pattern of spaced apart rows and/or columns.

7. The integral accessory attachment system of claim 4, wherein tunnel segments are created between said accessory apertures, between at least a portion of said accessory interface layer and said accessory panel.

8. The integral accessory attachment system of claim 4, wherein each of said accessory apertures comprises 2, spaced apart, substantially linear aperture sides, wherein each aperture side extends from an upper terminal end to a lower terminal end, wherein an arcuate side joins said upper terminal ends of said aperture sides, and wherein an arcuate side joins said lower terminal ends of said aperture sides.

9. The integral accessory attachment system of claim 1, wherein 2 or more attachment slots are formed at spaced apart locations through said attachment interface layer, and wherein tunnel segments are created between said attachment slots, between at least a portion of said attachment interface layer and said attachment panel.

10. An integral accessory attachment system, comprising:

an accessory body having an accessory panel, a connection portion, and an attachment panel, wherein one or more attachment elements extend as an integral extension of a portion of said attachment panel;

an attachment interface layer at least partially attached or coupled to at least a portion of said attachment panel, wherein a plurality of attachment slots are provided through at least a portion of said attachment interface layer, and wherein at least a portion of each of said one or more attachment elements is positionable through at least one of said attachment slots; and an accessory interface layer at least partially attached or coupled to at least a portion of said accessory panel, wherein a plurality of accessory apertures are formed through said accessory interface layer.

11. The integral accessory attachment system of claim 10, wherein at least one locking slot is formed through said attachment interface layer and wherein attachment element notches of each of said one or more attachment elements are positionable within said locking slot.

12. An integral accessory attachment system, comprising:

an accessory body having an accessory panel, a connection portion, and an attachment panel; and one or more attachment elements extending as an integral extension of a portion of said attachment panel, wherein a plurality of attachment slots are provided through at least a portion of said attachment panel, wherein said accessory apertures are formed in a repeating or semi-repeating pattern, and wherein at least a portion of each of said one or more attachment elements is positionable through at least one of said attachment slots.

13. The integral accessory attachment system of claim 12, wherein at least one locking slot is formed through said attachment panel such that at least a portion of attachment element notches of each of said one or more attachment elements are positionable within said locking slot.

14. The integral accessory attachment system of claim 13, wherein said attachment element notches comprise opposing attachment element notches formed in a portion of said attachment element and define a narrowed portion of said attachment element.

15. The integral accessory attachment system of claim 12, wherein a plurality of accessory apertures are formed through said accessory panel.

16. The integral accessory attachment system of claim 15, wherein an accessory interface layer at least partially attached or coupled to at least a portion of said accessory panel.

17. The integral accessory attachment system of claim 15, wherein said accessory apertures are formed in a repeating or semi-repeating pattern of spaced apart rows and/or columns.

18. The integral accessory attachment system of claim 15, wherein tunnel segments are created between said accessory apertures, between at least a portion of said accessory panel and a cavity of said accessory body.

19. The integral accessory attachment system of claim 15, wherein each of said accessory apertures comprises 2, spaced apart, substantially linear aperture sides, wherein each aperture side extends from an upper terminal end to a lower terminal end, wherein an arcuate side joins said upper terminal ends of said aperture sides, and wherein an arcuate side joins said lower terminal ends of said aperture sides.

20. The integral accessory attachment system of claim 12, wherein 2 or more attachment slots are formed at spaced apart locations through said attachment panel, and wherein tunnel segments are created between said attachment slots, between at least a portion of said attachment panel and a cavity of said accessory body.

* * * * *